US008034216B2

(12) United States Patent
Matuschczyk

(10) Patent No.: US 8,034,216 B2
(45) Date of Patent: Oct. 11, 2011

(54) ROLL COVER

(75) Inventor: Uwe Matuschczyk, Geislingen (DE)

(73) Assignee: Voith Patent GmbH, Heidenheim (DE)

( * ) Notice: Subject to any disclaimer, the term of this patent is extended or adjusted under 35 U.S.C. 154(b) by 677 days.

(21) Appl. No.: 12/088,597

(22) PCT Filed: Nov. 8, 2006

(86) PCT No.: PCT/EP2006/068218

§ 371 (c)(1),
(2), (4) Date: Mar. 28, 2008

(87) PCT Pub. No.: WO2007/068537

PCT Pub. Date: Jun. 21, 2007

(65) Prior Publication Data

US 2008/0251228 A1 Oct. 16, 2008

(30) Foreign Application Priority Data

Dec. 17, 2005 (DE) ..... 10 2005 060 590

(51) Int. Cl.
*D21F 3/08* (2006.01)

(52) U.S. Cl. ..... 162/358.3; 162/358.4; 492/48

(58) Field of Classification Search ..... 162/205–207, 162/306, 348, 358.3, 358.4, 361, 901; 100/151, 100/153; 428/163, 167, 304.4, 315.5, 315.9, 428/318.4; 492/20, 48
See application file for complete search history.

(56) References Cited

U.S. PATENT DOCUMENTS

| | | | | |
|---|---|---|---|---|
| 3,147,698 | A * | 9/1964 | Ross | 428/304.4 |
| 4,552,620 | A | 11/1985 | Adams | |
| 4,701,368 | A * | 10/1987 | Kiuchi et al. | 442/226 |
| 5,071,697 | A * | 12/1991 | Gulya et al. | 442/56 |
| 5,700,356 | A * | 12/1997 | Lefkowitz | 162/358.1 |
| 5,836,242 | A * | 11/1998 | Aberg | 100/327 |
| 6,383,339 | B1 * | 5/2002 | Gstrein | 162/358.4 |
| 6,858,291 | B2 * | 2/2005 | Sakuma et al. | 428/319.3 |
| 6,908,532 | B2 * | 6/2005 | Steiner et al. | 162/358.4 |
| 2002/0060052 | A1 | 5/2002 | Best | |
| 2004/0094282 | A1 * | 5/2004 | Danzler | 162/358.3 |
| 2004/0144515 | A1 | 7/2004 | Danzler | |

FOREIGN PATENT DOCUMENTS

| | | |
|---|---|---|
| EP | 0 859 082 B1 | 8/1998 |
| EP | 1 162 307 B1 | 12/2001 |
| EP | 1 293 601 A1 | 3/2003 |

OTHER PUBLICATIONS

Smook, Gary A., Handbook for Pulp & Paper Technologists, Angus Wilde Publications, 1992, pp. 256-258.*

* cited by examiner

*Primary Examiner* — Eric Hug
(74) *Attorney, Agent, or Firm* — Greenblum & Bernstein, P.L.C.

(57) ABSTRACT

The invention relates to a roll cover for treating a paper, cardboard, tissue or other fibrous web in a machine for manufacturing and/or converting them, comprising one or more plastic layers, of which at least one is of compressible configuration, and at least one carrier element in the form of a woven fabric, laid scrim or the like. Here, the loading of the support structure is intended to be reduced by at least one carrier element being embedded into a compressible plastic layer.

29 Claims, 1 Drawing Sheet

ROLL COVER

BACKGROUND OF THE INVENTION

1. Field of the Invention

The invention relates to a roll cover for treating a paper, cardboard, tissue or other fibrous web on a machine for producing and/or converting the same, comprising one or more plastic layers, of which at least one is of compressible configuration or structure, and at least one carrier element in the form of a woven fabric, laid scrim or the like. The invention also relates to a fibrous web treating machine that comprises such a roll cover.

2. Description of Background and Relevant Information

At present, the flexible roll covers for dewatering or smoothing the fibrous web are comprised essentially of a polyurethane matrix which is reinforced with a woven fabric or laid scrim.

To form a press nip, the roll covers are pressed toward a mating roll by a pressing element.

If a lump or the like runs in this case through the press nip, the result can be a permanent deformation or fracture of the woven fabric or laid scrim.

SUMMARY OF THE INVENTION

The invention reduces the loading of the carrier element.

To this end, according to the invention, at least one carrier element is embedded in a compressible plastic layer.

This is based on the knowledge that polyurethane is very wear-resistant but also incompressible, as the result of which the material gives way to the side when pressurized.

Therefore, the woven fabric has to absorb the main part of the load in the form of tensile stresses.

By embedding the carrier element in a compressible plastic layer, the latter is able, due to the given elasticity, to intercept a large part of the pressure load and thus relieve the carrier element.

Hence the effect can be improved further if—should there be several carrier elements—all the carrier elements are embedded in one or more plastic layers.

In this case it is possible for each carrier element to be embedded in an own plastic layer or for several carrier elements to be embedded in a common plastic layer.

The compressibility can be obtained or intensified simply by means of a porous structure, in particular a microcellular structure of the plastic layer.

Particularly suitable are microcellular structures which are formed within the plastic layer by closed, cellular bubbles with a diameter of less than 0.3 mm.

In this case it is an advantage for the compressible plastic layer to be formed by an elastomer, in particular polyurethane.

In particular with polyurethanes, microcellular structures can be formed relatively easily by adding water in the cross-linker, which leads to the formation of ultrafine $CO_2$ bubbles as the result of a chemical reaction.

Alternatively it is also possible to add air or an inert gas during the production of elastomers.

Due to the immense loading of the roll cover in the press nip for dewatering or smoothing the fibrous web, it is an advantage for the density of the compressible plastic layer to be less than 1.1 g/cm$^3$, preferably between 0.4 and 0.8 g/cm$^3$, in order to lend optimum loading properties to the roll cover.

The compressive strain characteristic of the compressible layer is characterized essentially in that it is between 10 and 40% linear elastic in the region of a compressive strain. In the compressive strain region, the compressive strain modulus E, as the relationship between the applied compressive stress $\varsigma$ and the resulting compressive strain $\epsilon$, is constant.

$$\left(E = \frac{\varsigma}{\varepsilon}\right)$$

In the case of a compressive strain of more than 40%, the pressure required for the same increases progressively because the entrained air is compressed.

In the evacuated density range between 0.4 and 0.8 g/cm$^3$ and a compressive strain between 10 and 40%, the compressive strain modulus E lies between 1 and 5 MPa.

During the dewatering of the fibrous web it is advantageous for the outer side of the roll cover to have flutes and/or blind bores in order to pick up a part of the expelled water in the interest of a high dewatering capacity.

From the production engineering point of view it is particularly advantageous for the roll cover to be comprised of only one plastic layer.

If the outer side of the roll cover is processed in this case, this can result in the formation of an open-pore structure on the surface.

This can be irrelevant for the treatment of the fibrous web or be used consciously to roughen the outer side.

However, it can be an advantage for the roll cover to comprise several plastic layers, of which at least one is compressible, in order to adapt to the special requirements imposed on the roll cover.

In this case the incompressible plastic layer should be formed, above all due to the high wear resistance, from an elastomer, in particular polyurethane.

If the inner side of the roll cover should be particularly wear-resistant and/or smooth, then it is an advantage for the inner side to be formed from an incompressible plastic layer.

This applies in particular if processing of the inner side of the roll cover is necessary, because an open-pore and hence rough surface results on an inventive compressible plastic layer as the result of said processing.

In applications in which no processing of the inner side is necessary or roughness caused by said processing has no adverse effect or is even desired, the inner side of the roll cover should be formed by a compressible plastic layer.

Greater roughness can promotes for examples the lubrication between the roll cover and a pressing element because more lubricant is conveyed into the lubricating gap as the result.

In the interest of greater wear resistance on the outer side of the roll cover it is advantageous for the outer side of the roll material to be formed by an incompressible plastic layer.

To ensure sufficient strength of the roll material, the ratio between the volume of the carrier element and the volume of the compressible plastic layer should be greater than or equal to 0.1, preferably greater than or equal to 0.2.

Advantages in terms of strength and production result in this case if the carrier element is formed by threads (i.e., threads, yarns, or filaments, etc.), extending transversely and in the circumferential direction.

To realize a compact carrier element, the distance between the threads extending in one direction should be smaller than 3 mm and the distance between intersecting threads should be between 0 and 4 mm, preferably between 0 and 1 mm.

In this case it is also an advantage for the flutes and/or blind bores to be completely within the incompressible plastic layer.

In addition to a roll cover itself, the invention encompasses a machine for treating a fibrous web, such machine including a roll cover as described herein.

BRIEF DESCRIPTION OF THE DRAWINGS

The invention is described in more detail below using several exemplary embodiments. In the appended drawing.

DETAILED DESCRIPTION OF THE INVENTION

Figure 4:
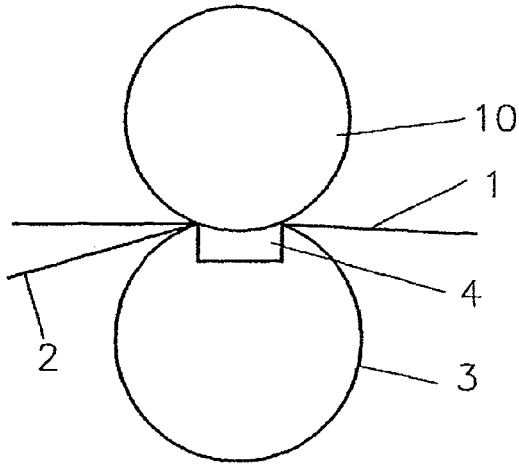
FIG. 4 shows a schematic cross section through a press arrangement.

As can be seen in FIG. 4, the inventive roll cover 3 is part of a press roll, whereby the flexible and approximately cylindrical roll cover 3 is pressed toward a mating roll 10 by a pressing element 4 with a concave press surface.

This results in the formation of an extended press nip through which a water-absorbing dewatering belt 2 is passed in addition to the fibrous web 1. Upon passing through the press nip, the roll cover 3 is subjected to considerable deformations. For this reason, the roll cover 3 is comprised essentially of polyurethane and, for example, a carrier element 5 in the form of a laid scrim for reinforcement.

In this case the laid scrim, which is comprised of threads extending in the axial and circumferential direction, is fully encompassed by polyurethane, as the result of which the strength carrier is protected from wear and damage.

Because the polyurethane is normally very wear-resistant but relatively incompressible, there is a risk of the carrier element 5 becoming permanently elongated or even broken, in particular when lumps or the like pass through.

For this reason the carrier element 5 is embedded in a plastic layer 6 made of polyurethane with a microcellular structure. The microcellular structure is formed in this case by distributed bubbles 11 with a diameter of less than 0.3 mm.

The microcellular structure leads to an improved compressibility of the plastic layer 6 and therefore relieves the carrier element 5 in case of compressive loading.

The density of the compressible plastic layer 6 lies between 0.4 and 0.8 g/cm$^3$.

Figure 3:
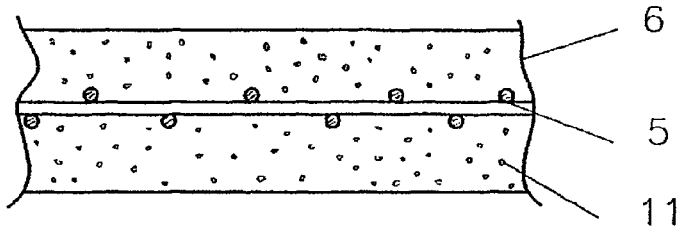
FIG. 3 shows a roll cover without an incompressible layer.

According to FIG. 3, the entire roll cover 3 is comprised of only the compressible plastic layer 6 made of polyurethane. This considerably simplifies the production of the roll cover 3.

Figure 1:
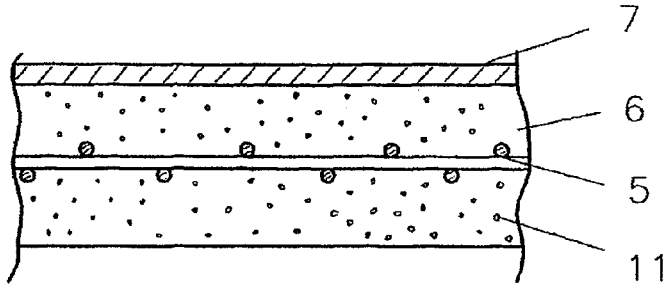
FIG. 1 shows a roll cover 3 with an incompressible outer layer.

To be able to ensure the wear resistance and high degree of smoothness on the outer side of the roll cover 3, the roll cover 3 according to FIG. 1 has an outer, incompressible plastic layer 7 made of solid polyurethane.

Because both plastic layers 6, 7 are comprised of the same material, the joining of the two is non-problematic and stable.

Figure 2:
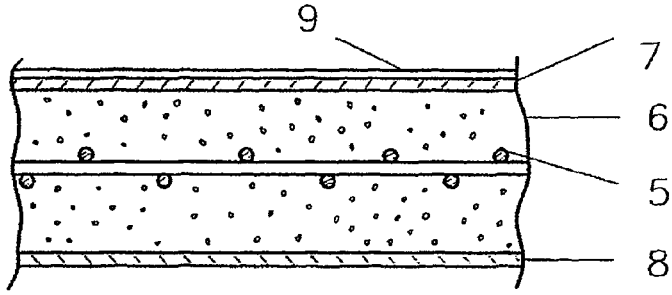
FIG. 2 shows a roll cover with an incompressible inner and outer layer.

The roll cover 3 represented in FIG. 2 has an incompressible inner plastic layer 8 made of solid polyurethane in addition to the incompressible outer plastic layer 7.

In this case the wear-resistant, smooth inner plastic layer 8 permits subsequent processing during production of the roll cover 3 without risk of forming open pores and hence of roughening the surface.

For example the roll cover in FIG. 2 has flutes 9 extending on the outer side in circumferential direction in order to pick up water during the dewatering of the fibrous web 1.

The flutes 9 extend completely within the incompressible, outer plastic layer 7, which has a positive effect on the wear and dimensional stability of the flutes 9.

The invention claimed is:

1. A roll cover for treating a paper, cardboard, or tissue web, said roll cover comprising:
- one or more plastic layers, at least one of said plastic layers having a compressible structure;
- at least one carrier element; and
- said at least one carrier element being embedded in the compressible plastic layer such that portions of the compressible plastic layer are arranged on opposite sides of said at least one carrier element,
- wherein the roll cover is arranged on a machine for treating or producing paper, cardboard or tissue.

2. A roll cover according to claim 1, wherein:
said at least one carrier element comprises a woven fabric.

3. A roll cover according to claim 1, wherein:
said at least one carrier element comprises a laid scrim.

4. A roll cover according to claim 1, wherein:
all of said at least one carrier element is/are embedded in one or more compressible plastic layers.

5. A roll cover according to claim 1, wherein:
the compressible plastic layer has a porous microcellular structure.

6. A roll cover according to claim 5, wherein:
the microcellular structure comprises bubbles having a diameter of less than 0.3 mm within the plastic layer.

7. A roll cover according to claim 1, wherein:
the compressible plastic layer comprises a polyurethane elastomer.

8. A roll cover according to claim 1, wherein:
the compressible plastic layer has a density of less than 1.1 g/cm$^3$.

9. A roll cover according to claim 1, wherein:
the compressible plastic layer has a density of between 0.4 and 0.8 g/cm$^3$.

10. A roll cover according to claim 1, wherein:
an outer side of the roll cover has flutes and/or blind bores.

11. A roll cover according to claim 1, wherein:
the roll cover is comprised of only one plastic layer.

12. A roll cover according to claim 1, wherein:
the roll cover is comprised of several plastic layers of which at least one is incompressible.

13. A roll cover according to claim 12, wherein:
the incompressible plastic layer is formed by a polyurethane elastomer.

14. A roll cover according to claim 12, wherein:
an inner side of the roll cover is formed by an incompressible plastic layer.

15. A roll cover according to claim 12, wherein:
an inner side of the roll cover is formed by a compressible plastic layer.

16. A roll cover according to claim 12, wherein:
an outer side of the roll cover is formed by an incompressible plastic layer.

17. A roll cover according to claim 1, wherein:
a ratio between a volume of the carrier element and a volume of the compressible plastic layer is greater than or equal to 0.1.

18. A roll cover according to claim 1, wherein:
a ratio between a volume of the carrier element and a volume of the compressible plastic layer is greater than or equal to 0.2.

19. A roll cover according to claim 1, wherein:
the carrier element is formed by threads extending transversely and in circumferential direction.

20. A roll cover according to claim 19, wherein:

a distance between the threads extending in one direction is less than 3 mm.

21. A roll cover according to claim 19, wherein one of:

a distance between intersecting threads is between 0 and 4 mm, and a distance between intersecting threads is between 0 and 1 mm.

22. A roll cover according to claim 19, wherein:

a distance between intersecting threads is between 0 and 1 mm.

23. A roll cover for treating a paper, cardboard, tissue or other fibrous web on a machine for producing and/or converting the same, said roll cover comprising:

one or more plastic layers, at least one of said plastic layers having a compressible structure;

at least one carrier element; and said at least one carrier element being embedded in the compressible plastic layer such that portions of the compressible plastic layer are arranged on opposite sides of said at least one carrier element, wherein the roll cover is comprised of several plastic layers of which at least one is incompressible, wherein an outer side of the roll cover is formed by an incompressible plastic layer, and wherein the flutes and/or blind bores are completely within the incompressible plastic layer.

24. A machine for treating a paper, cardboard or tissue web, said machine comprising:

a press nip for applying pressure to the paper, cardboard or tissue web passing through said press nip;

said press nip comprising a press roll;

a roll cover extending over said press roll, said roll cover comprising:

one or more plastic layers, at least one of said plastic layers having a compressible structure; and at least one carrier element;

said at least one carrier element being embedded in the compressible plastic layer such that portions of the compressible plastic layer are arranged on opposite sides of said at least one carrier element.

25. A machine according to claim 24, wherein:

said press nip further comprises a mating roll, said roll cover being pressed toward the mating roll.

26. A machine according to claim 24, further comprising:

a dewatering belt passing through said press nip with said paper, cardboard or tissue web.

27. A machine according to claim 24, wherein:

said at least one carrier element comprises a woven fabric.

28. A machine according to claim 24, wherein:

said at least one carrier element comprises a laid scrim.

29. A machine according to claim 24, wherein:

all of said at least one carrier element is/are embedded in one or more compressible plastic layers.

* * * * *